US006280841B1

(12) United States Patent
Miyazawa et al.

(10) Patent No.: US 6,280,841 B1
(45) Date of Patent: Aug. 28, 2001

(54) PACKAGE OF POLYURETHANE ELASTIC YARN FOR HEAT BONDING

(75) Inventors: Fumio Miyazawa; Nobuya Morishita, both of Aichi; Keiko Noda, Toyokawa, all of (JP)

(73) Assignee: Fuji Spinning Co., Ltd., Tokyo (JP)

( * ) Notice: Subject to any disclaimer, the term of this patent is extended or adjusted under 35 U.S.C. 154(b) by 0 days.

(21) Appl. No.: 09/376,011

(22) Filed: Aug. 18, 1999

(30) Foreign Application Priority Data

May 14, 1999 (JP) ..... 11-133567

(51) Int. Cl.[7] ..... B32B 27/00

(52) U.S. Cl. ..... 428/394; 428/375; 428/378; 428/395; 53/430; 28/289

(58) Field of Search ..... 428/375, 394, 428/395, 378; 28/289, 290, 220; 53/430, 439

(56) References Cited

U.S. PATENT DOCUMENTS 4,525,420 * 6/1985 Imai et al. ..... 428/372
5,110,865 * 5/1992 Ona et al. ..... 524/838
5,851,431 * 12/1998 Ishikawa et al. ..... 252/312
5,879,799 * 3/1999 Yosizato et al. ..... 428/364

FOREIGN PATENT DOCUMENTS 1226669A 9/1989 (JP) .
10152264A 6/1998 (JP) .

* cited by examiner

*Primary Examiner*—Cynthia Harris
*Assistant Examiner*—J. M. Gray
(74) *Attorney, Agent, or Firm*—Birch, Stewart, Kolasch & Birch, LLP

(57) ABSTRACT

A package of polyurethane elastic yarn for heat bonding which weighs more than 1 kg and measures such that the diameter-to-width ratio is greater than 0.5 and which is obtained from polyurethane elastic yarn by giving it 3.0–10.0 wt % of a finishing agent and then winding it up, said finishing agent is polypropylene glycol-based polyol used alone or composed of component (A) which is a polypropylene glycol-based polyol and component (B) which is a reaction product of a polypropylene glycol-based polyol and an organic diisocyanate compound. The finishing agent contains component (B) in an amount less than 30 wt % and have an apparent viscosity of 50–250 mPa·s at 30° C. and a surface tension of 30–45 dyn/cm.

10 Claims, No Drawings

PACKAGE OF POLYURETHANE ELASTIC YARN FOR HEAT BONDING

BACKGROUND OF THE INVENTION

1. Field of the Invention

The present invention relates to a package of polyurethane elastic yarn to be used for heat bonding. More particularly, the present invention relates to a package of polyurethane elastic yarn to be used to form the waist and leg parts of disposable diaper which need elastic properties. The polyurethane elastic yarn exhibits good bonding properties when disposable diapers undergo bonding such as hot-melt bonding, fusion bonding, and ultrasonic bonding during their production. The package keeps its good appearance in shape without slipping down of yarn layer and also permits good unwinding without mutual sticking of the polyurethane elastic yarn.

2. Description of the Prior Art

Owing to its good elastic properties, polyurethane elastic yarn is used in various fields where extensibility and fittability are required. Polyurethane elastic yarn is usually supplied in the form of package and hence it is given a finishing agent so that it does not stick mutually in the package and it is unwound without unnecessary resistance.

In addition, in the case where polyurethane elastic yarn is used continuously it is necessary to replace packages frequently. The less the amount of yarn in the package, the greater the frequency of replacement. In order to reduce the frequency of package replacement, it has become common practice to make packages larger. In the case of large packages, application of finishing agent is indispensable to prevent yarn sticking which occur particularly in the core layer of the package.

Unfortunately, a polyurethane elastic fiber treated with a finishing agent has the disadvantage of being very poor in bonding properties due to the finishing agent present on it. This is true in the case where the gather of a disposable diaper is formed by adhesion or heat bonding with another material.

One way to solve this problem is disclosed in Japanese Patent Publication No. 50429/1993. According to this disclosure, a polyurethane elastic yarn is given a finishing agent composed mainly of silicone oil in an amount less than 2 wt % and then wound up such that its apparent elongation in the package is within a certain range for the amount of the finishing agent applied. Such polyurethane elastic yarn exhibits good adhesion properties with adhesive in the production of disposable diapers. The advantage of this method is that the polyurethane elastic fiber is not so poor in adhesion properties because of the smaller amount less than 2 wt % of the finishing agent used. On the other hand, this method has the disadvantage that the package of the polyurethane elastic yarn gives a poor appearance in shape because it is wound up with a lower tension than usual so as to prevent mutual sticking of yarn. This is true in the case where the apparent elongation is low even though it is within the certain range for the amount of the finishing agent used. Conversely, with a great apparent elongation, the polyurethane elastic yarn is not unwound smoothly due to mutual sticking of the yarn in the package. Thus, it is substantially difficult to obtain the package of polyurethane elastic yarn which appearance has a good in shape and is unwound smoothly by simply reducing the amount of finishing agent and defining the apparent elongation.

Japanese Patent Laid-open No. 152264/1998 discloses a package of elastic yarn which is given 2–5 wt % of a finishing agent, for example silicone oil, having a surface tension of 25–30 dyn/cm. It is claimed that this package is unwound smoothly and keeps its adhesion properties when used to make a disposable diaper. However, it has been found that the finishing agent having a surface tension of 25–30 dyn/cm as specified above does not provide satisfactory adhesion properties even when it is used in an amount of 2–5 wt %.

BRIEF SUMMARY OF THE INVENTION

The present invention was completed in order to overcome the above-mentioned disadvantages. Thus, it is an object of the present invention to provide a package of polyurethane elastic yarn for heat bonding, said package keeping its good appearance in shape and being capable of unwinding adequately without mutual sticking of yarn. This object is achieved by giving polyurethane elastic yarn a finishing agent which exhibits excellent heat bonding properties and permits smooth unwinding while preventing mutual sticking of yarn in the package.

The present invention covers a package of polyurethane elastic yarn for heat bonding which is obtained from polyurethane elastic yarn by giving it 3.0–10.0 wt % of a finishing agent and then winding it, said finishing agent being composed of component (A) which is a polypropylene glycol-based polyol and component (B) which is a reaction product of a polypropylene glycol-based polyol and an organic diisocyanate compound. According to the present invention, the finishing agent should preferably contain component (B) in an amount less than 30 wt % or it may contain component (A) alone. According to the present invention, the finishing agent should have an apparent viscosity of 50–250 mPa·s at 30° C. and a surface tension of 30–45 dyn/cm. According to the present invention, the package of polyurethane elastic yarn for heat bonding weighs more than 1 kg and measures such that the ratio of winding thickness to winding width is greater than 0.5.

DETAILED DESCRIPTION OF THE INVENTION

The polyurethane elastic yarn in the present invention is not specifically restricted. It may be either one which is obtained by wet spinning or dry spinning or by melt spinning. The polyurethane elastic yarn may be incorporated with a light stabilizer, a UV light absorbent, an agent to prevent discoloration by gas, a dye, an activating agent, a delustering agent, etc.

Component (A) which is used as a finishing agent in the present invention is a polypropylene glycol-based polyol, which is a diol and/or triol obtained by polymerization of propylene oxide alone or with ethylene oxide and has a weight-average molecular weight of 200–1500. With the molecular weight lower than 200, it unfavorably contains a low-molecular weight fraction which hinders heat bonding. With the molecular weight higher than 1500, it has such a high viscosity as to cause mutual sticking of yarn, preventing smooth unwinding. Incidentally, the polyol may have its hydroxyl groups partly esterified or acylated.

Component (B) is a reaction product of a polypropylene glycol-based polyol and an organic diisocyanate compound. The polyol is a diol and/or triol obtained by polymerization of propylene oxide alone or with ethylene oxide. The organic diisocyanate compound is one or more members selected from 4,4'-diphenylmethane diisocyanate, 3,3'-dichloro-4,4'-diphenylmethane diisocyanate, m-xylylene diisocyanate, 2,4-tolylene diisocyanate, 2,6-tolylene diisocyanate, hexamethylene diisocyanate, etc.

The polypropylene glycol-based polyol should preferably have a weight-average molecular weight of 200–2000. With a molecular weight lower than 200, it would cause obtained component (B) to increase a content of hard segments which gives rise to undesirable gel. With the molecular weight higher than 2000, it would cause obtained component (B) to have a high apparent viscosity which results in mutual sticking of yarn and makes unwinding difficult.

The reaction to produce the component (B) should be carried out in such a way that the amount of isocyanate groups in an organic diisocyanate compound or the total amount of isocyanate groups in two or more organic diisocyanate compounds is 50–90 eq %, preferably 50–70 eq %, of the amount of hydroxyl groups in the polyol used. If the ratio of isocyanate groups is higher than this, obtained component (B) has such a high degree of polymerization that it is poor in compatibility with component (A) and hence the resulting finishing agent has an adverse effect on unwinding. Moreover, if the ratio of isocyanate groups is more higher, obtained component (B) contains residual isocyanate groups which react with component (A) and the resulting finishing agent has a viscosity outside the range specified in the present invention. Conversely, if the ratio of isocyanate groups is lower than specified above, the polyol partly remains unreacted, producing an adverse effect on heat bonding properties. The reaction condition is not specifically restricted so long as it permits complete reaction between the polyol and the organic diisocyanate.

The finishing agent of the present invention is a polypropylene glycol-based polyol alone or a mixture of component (A), which is a polypropylene glycol-based polyol, and component (B), which is a reaction product of a polypropylene glycol-based polyol and an organic diisocyanate compound. The finishing agent contains component (B) in an amount less than 30 wt %. According to the present invention, the finishing agent should have an apparent viscosity of 50–250 mPa·s at 30° C. and a surface tension of 30–45 dyn/cm. If the ratio of component (B) is higher than 30 wt %, the finishing agent has an adverse effect of unwinding. If the apparent viscosity is lower than 50 mPa·s, the finishing agent has an adverse effect on heat bonding properties. If the apparent viscosity is higher than 250 mPa·s, the finishing agent results in mutual sticking of yarn and poor unwinding due to uneven application of the finishing agent. If the surface tension is lower than 30 dyn/cm, the finishing agent has an adverse effect on heat bonding. If the surface tension is higher than 45 dyn/cm, the finishing agent results in mutual sticking of yarn and poor unwinding.

As mentioned above, component (B) used in the present invention is a urethane-based compound with a low degree of polymerization. Therefore, the finishing agent containing it produces the effect of preventing mutual sticking of yarn and promoting heat bonding when applied to polyurethane elastic yarn.

According to the present invention, the finishing agent may be composed of component (A) alone without component (B). Such a single-component finishing agent permits the elastic yarn to exhibit good heat bonding properties and produces the effect of preventing mutual sticking of yarn and promoting unwinding. However, for better heat bonding properties, it is desirable that the finishing agent contain component (B) in an amount less than 30 wt %, preferably 5–30 wt %.

According to the present invention, the finishing agent is applied to polyurethane elastic yarn such that the loading is 3.0–10.0 wt %. Application may be accomplished by bringing the polyurethane elastic yarn into contact with a roller carrying the finishing agent while polyurethane elastic yarn travels from the spinneret to a paper tube or from one package to another for rewinding.

With a loading less than 3.0 wt % of the finishing agent mutual sticking of yarn is caused, adversely affecting unwinding, and also heat bonding properties are deteriorated. With the loading in excess of 10.0 wt % of the finishing agent adversely affects the shape of package.

As mentioned above, the package of the present invention keeps its good appearance in shape and the polyurethane elastic yarn wound on the package of the present invention exhibits good heat bonding properties, does not stick mutually, and is unwound adequately.

As mentioned above, the present invention provides a package of polyurethane elastic yarn. This yarn has good bonding properties and does not stick mutually in the package, and the package permits the yarn to be unwinded smoothly while keeping its good appearance in shape. These effects are produced when polyurethane elastic yarn is given a finishing agent in an amount of 3.0–10.0 wt %. The finishing agent is polypropylene glycol-based polyol used alone or a mixture of component (A) which is polypropylene glycol-based polyol and component (B) which is a reaction product of polypropylene glycol-based polyol and an organic diisocyanate compound. The finishing agent has an apparent viscosity of 50–250 mPa·s at 30° C. and a surface tension of 30–45 dyn/cm.

The package of polyurethane elastic yarn can be made larger easily and the polyurethane elastic yarn will be used in various fields where heat bonding is required.

EXAMPLES

Examples are given in the following; however, they are not intended to restrict the scope of the invention. "Parts" means "parts by weight". Viscosity was measured by using a Brookfield rotary viscometer. The following methods were used to determine the loading of finishing agent and to examine samples for unwinding properties, appearance of package in shape, and heat bonding properties.

<Loading of Finishing Agent>

A sample of polyurethane elastic yarn with a finishing agent was allowed to stand overnight at 20° C. and 65% RH. About 2.0–2.5 g of the sample was weighed $W_1$ g accurately. The weighed sample was ultrasonically treated for 10 minutes in 3 liters of petroleum ether. The sample was vacuum-dried at 80° C. for 30 minutes and then allowed to stand at 20° C. and 65%RH for more than 1 hour. The sample was weighed $W_2$ g accurately. The same procedure as above was repeated for a sample of polyurethane elastic yarn without finishing agent to determine $W_1'$ g and $W_2'$ g. The loading (%) of finishing agent was calculated from the following equation.

$$\text{Loading } (\%)=\{(W_1-W_2)/W_2-(W_1'-W_2')/W_2'\}\times 100$$

<Unwinding Properties>

A package of polyurethane elastic yarn had its surface layer removed to such an extent that the core layer had a thickness of about 2 cm. The yarn was positively unwound from the package at a rate of 10 m/min and wound up on a paper tube placed 50 cm away from center to center. The rate of winding was gradually reduced until the unwound yarn was pulled by mutual sticking of yarn in the direction in which the package turns. Then the minimum rate S m/min of winding was measured. The unwinding properties in % was calculated from the following equation. This test was carried out immediately after the package was made and also after the package was allowed to stand for one month at room temperature.

Unwinding properties (%)=(S−10)/10×100 Incidentally, a value of 0% means that the elastic yarn can be unwound without tension. In such a case, the elastic yarn would not keep the shape of package. The value for unwinding properties should preferably be in the range of 40–70%.

<Appearance of Package in Shape>

The package of polyurethane elastic yarn was examined for shape and rated on a scale of one to four according to the following criteria.

1: Getting out of appearance in shape as a whole and being observed remarkable projecting yarn because of slipping down of yarn layer and unevenness of winding.
2: Poor appearance in shape as a whole with projecting yarn because of slipping down of yarn layer and unevenness of winding.
3: Poor appearance in shape without slipping down of yarn layer or unevenness of winding.
4: Good appearance in shape.

<Bonding properties>

Eight pieces of polyurethane elastic yarn 8 cm long taken from each sample were placed side by side on a spun-bond nonwoven fabric of polypropylene. A tape of 10 mm wide of spun-bond nonwoven fabric of polypropylene was placed on a center portion of the polyurethane elastic yarn at right angles. This tape has a uniform coating of hot melt applied by rolling at 145° C. ("Haibon H9610" from Hitachi Kasei Polymer Co., Ltd.). The tape was pressed under a load of about 8.4 g/cm$^2$ for 1 minute. The nonwoven fabric on which the polyurethane elastic yarns were bonded by the tape was cut into small pieces along each polyurethane elastic yarn. One end of the elastic yarn and one end of the polypropylene nonwoven fabric were held respectively by the grips of a tensile testing machine ("Tensilon RTA-100" from Orientekku Co., Ltd.). The specimen was pulled at a rate of 400 mm/min to measure the force required for the elastic yarn to be pulled off from the polypropylene nonwoven fabric.

Example 1

Polyoxytetramethylene glycol of 2869 parts with a number-average molecular weight of 1818 and 4,4'-diphenylmethane diisocyanate of 631 parts were mixed at 45° C. and reacted at 75° C. for 80 minutes. There was obtained urethane prepolymer of 3500 parts.

A mixed solution of chain extender and chain terminator was prepared from 56.4 parts ethylenediamine as a chain extender, 2.1 parts of diethylamine as a chain terminator, and 136.4 parts of N,N-dimethylacetamide cooled to 0° C.

The urethane prepolymer of 3400 parts was added to 7933 parts of N,N-dimethylacetamide cooled to 0° C. After thorough stirring, the prepolymer solution was mixed with the solution of chain extender and chain terminator in such an amount that the total mole amount of active hydrogen in the chain extender and chain terminator was equal to the amount of isocyanate groups in the urethane prepolymer. After reaction, there was obtained a solution of polyurethane.

The solution of polyurethane was extruded from a spinneret into hot air for dry spinning. The yarn with false twist was brought into contact with a roller carrying a finishing agent which is polypropylene glycol which is obtained by polymerization of propylene oxide having a weight-average molecular weight of 400, a viscosity of 73mPa·s, and a surface tension of 36.4 dyn/cm. The rotary speed of the roller was adjusted so that the loading of the finishing agent was 1.0, 3.0, 10.0, and 14.5%. The treated yarn was wound up on a paper tube at a rate of 500 m/min, with an elongation of 7%. Thus there was obtained four packages each weighing 3.0 kg of 560-denier polyurethane elastic yarn consisting of 56 filaments. Samples of package varying in the loading of finishing agent were designated as Sample No.1 to No. 4, respectively. Incidentally, each package had a thickness-to-width ratio of 1.6.

Four packages of polyurethane elastic yarn as Comparative Sample No. 1 were prepared in the same way as above except that the finishing agent was not used.

The thus obtained samples of polyurethane elastic yarn were examined for unwinding properties, bonding properties, and appearance of package in shape. The results are shown in Table 1.

TABLE 1

| | | Sample No. | | | | Comparative Sample |
|---|---|---|---|---|---|---|
| | | No. 1 | No. 2 | No. 3 | No. 4 | No. 1 |
| Finishing agent (A):(B) | | 100:0 | 100:0 | 100:0 | 100:0 | — |
| Loading of finishing agent (%) | | 1.2 | 3.1 | 9.8 | 14.5 | — |
| Unwinding properties (%) | Immediately after preparation | 37 | 43 | 44 | 50 | 36 |
| | After one month | 79 | 69 | 63 | 58 | 86 |
| Appearance of package in shape | | 4 | 4 | 4 | 3 | 4 |
| Bonding properties (g) | | 34.7 | 35.9 | 36.0 | 35.2 | 36.1 |

It is apparent from Table 1 that Comparative Sample No. 1 which was not given the finishing agent was good in bonding properties and appearance of package in shape but became poor in unwinding properties after one month. By contrast, Samples No. 1 to No. 4 which were given the finishing agent composed of component (A) or polypropylene glycol-based polyol were good in bonding properties. But Sample No. 1 is not good in unwinding properties because of the less loading of finishing agent. And Sample No. 4 is poor in appearance of package in shape because of the excess loading of finishing agent. Samples No. 2 and No. 3 which were given the finishing agent in an amount of 2.0–10.0 wt % as specified in the present invention were good in bonding properties, unwinding properties, and appearance of package in shape.

Example 2

A solution of polyurethane was prepared in the same way as in Example 1. The solution was extruded from a spinneret into hot air for dry spinning. The yarn with false twist was brought into contact with a roller carrying a finishing agent which is polypropylene glycol obtained by polymerization of propylene oxide having a weight-average molecular weight of 150, 200, 400, 1000, or 2000, respectively, a viscosity of 47, 56, 70, 150, or 310 mPa·s, respectively, and a surface tension of 35.5, 36.1, 36.5, 37.2, or 37.4 dyn/cm, respectively. The rotary speed of the roller was adjusted so that the loading of the finishing agent was 5.0±0.5%. The treated yarn was wound up respectively on a paper tube at a rate of 500 m/min, with an elongation of 7%. Thus there was obtained two packages each weighing 3.0 kg of 560-denier polyurethane elastic yarn consisting of 56 filaments. Samples of package varying in the molecular weight of finishing agent were designated as Sample No.5 to No. 9, respectively. Incidentally, each package had a thickness-to-width ratio of 1.6.

The thus obtained samples of polyurethane elastic yarn were examined for unwinding properties, bonding properties, and appearance of package in shape. The results are shown in Table 2.

TABLE 2

| | Sample No. | | | | |
|---|---|---|---|---|---|
| | No. 5 | No. 6 | No. 7 | No. 8 | No. 9 |
| Finishing agent | | | | | |
| (A):(B) | 100:0 | 100:0 | 100:0 | 100:0 | 100:0 |
| Average molecular weight | 150 | 200 | 400 | 1500 | 2000 |
| Viscosity (mPa · s) | 47 | 56 | 70 | 180 | 310 |
| Surface tension (dyn/cm) | 35.5 | 36.1 | 36.5 | 37.2 | 37.4 |
| Loading (%) | 5.2 | 5.4 | 5.3 | 5.1 | 5.1 |
| Unwinding properties (%) | | | | | |
| Immediately after preparation | 39 | 40 | 43 | 58 | 73 |
| After one month | 67 | 68 | 66 | 68 | 79 |
| Appearance of package in shape | 4 | 4 | 4 | 4 | 4 |
| Bonding properties (g) | 28.6 | 35.0 | 36.2 | 36.7 | 35.8 |

It is apparent from Table 2 that Sample No. 5 is poor in bonding properties because it is treated with the finishing agent composed of component (A) of polypropylene glycol-based polyol alone, which has a low average molecular weight and a low viscosity which is outside of this invention. Sample No. 9 is poor in unwinding properties because the finishing agent has a high average molecular weight and a high viscosity. By contrast, Sample No. 6 to No. 8 pertaining to the present invention are good in bonding properties, unwinding properties, and appearance of package in shape.

components warmed respectively at 60° C. in such a ratio that the amount of isocyanate groups is 50 eq % of the amount of hydroxyl groups, in a stainless steel vessel warmed at 60° C. sealed with nitrogen gas. The two components were heated to 90° C. during mixing by a screw stirrer and reaction was continued at 90° C. for 6 hours. After then components (A) and (B) were mixed in a ratio of 100:0, 95:5, 90:10, 70:30, and 60:40 so that the resulting mixture finishing agent had a viscosity of 52, 65, 70, 245, and 290 mPa·s at 30° C., respectively, and a surface tension of 36.1, 35.1, 35.3, 33.9, and 321.2 dyn/cm, respectively.

A solution of polyurethane was prepared in the same way as in Example 1. The solution was extruded from a spinneret into hot air for dry spinning. The yarn with false twist was brought into contact with a roller carrying one of the five finishing agents which were prepared as mentioned above. The rotary speed of the roller was adjusted so that the loading of the finishing agent was 7.5±0.5%. The treated yarn was wound up on a paper tube at a rate of 500 m/min, with an elongation of 5%. Thus there was obtained two packages each weighing 2.0 kg of 560-denier polyurethane elastic yarn consisting of 56 filaments. Samples of package varying in the ratio of components (A) and (B) of finishing agent were designated as Sample No. 10 to No. 14, respectively. Two packages of polyurethane elastic yarn as Comparative Sample No. 2 was prepared in the same way as above except that the finishing agent was not used. Incidentally, each package had a thickness-to-width ratio of 1.2.

The thus obtained samples of polyurethane elastic yarn were examined for bonding properties and loading of finishing agent, and the sample of package were examined for appearance of package in shape and unwinding properties. The results are shown in Table 3.

TABLE 3

| | Sample No. | | | | | Comparative |
|---|---|---|---|---|---|---|
| | No. 10 | No. 11 | No. 12 | No. 13 | No. 14 | Sample No. 2 |
| Finishing agent (A):(B) | 100:0 | 95:5 | 90:10 | 70:30 | 60:40 | — |
| Viscosity of finishing agent (mPa · s) | 52 | 65 | 70 | 245 | 290 | — |
| Surface tension of finishing agent (dyn/cm) | 36.1 | 35.1 | 35.3 | 33.9 | 31.2 | — |
| Loading of finishing agent (%) | 7.2 | 7.5 | 7.4 | 7.8 | 7.5 | — |
| Unwinding properties (%) | | | | | | |
| Immediately after preparation | 42 | 48 | 54 | 65 | 91 | 35 |
| After one month | 58 | 57 | 63 | 69 | 95 | 86 |
| Appearance of package in shape | 4 | 4 | 4 | 4 | 3 | 4 |
| Bonding properties (g) | 35.3 | 38.2 | 40.1 | 41.2 | 42.7 | 35.9 |

Example 3

As component (A) of the finishing agent, polypropylene glycol-based polyol having a weight-average molecular weight of 200 was prepared by polymerization from 90 parts of propylene oxide and 10 parts of ethylene oxide. As component (B) of the finishing agent, a compound was prepared by reaction between polypropylene glycol having a weight-average molecular weight of 2000 which is a homopolymer of propylene oxide and 4,4'-diphenylmethane diisocyanate. The reaction was carried out by mixing the two It is apparent from Table 3 that Comparative Sample No. 2, which was not given the finishing agent, was good in bonding properties but became poor in unwinding properties one month after production. Since this is due to mutual sticking of yarn that occurred with time in the package, probably, the sample was not preferable. Sample No. 14 was poor in unwinding properties due to mutual sticking of yarn even immediately after production and also poor in appearance of package in shape because the ratio of component (B) to component (A) is too high.

By contrast, Sample No. 10, which was given the finishing agent composed of component (A) only, is good in bonding properties although not better than Comparative Sample No. 2 and good in unwinding properties without mutual sticking of yarn.

Samples No. 11 to No. 13, which were given the finishing agent composed of component (A) and 5–30 wt % of component (B), are better than Comparative Sample No. 2, which was not given the finishing agent, in bonding properties, appearance of package in shape, and unwinding properties. In addition, they remain unchanged in unwinding properties even one month after production. This suggests that mutual sticking of yarn did not occur during storage.

Example 4

As component (A) of the finishing agent, polypropylene glycol-based polyol having a weight-average molecular weight of 400 was prepared by polymerization from propylene oxide alone. As component (B) of the finishing agent, a compound was prepared by reaction between polypropylene glycol having a weight-average molecular weight of 400 which is a homopolymer of propylene oxide and 4,4'-diphenylmethane diisocyanate. The reaction was carried out by mixing the two components warmed respectively at 60° C. in such a ratio that the amount of isocyanate groups is 70 eq % of the amount of hydroxyl groups, in a stainless steel vessel warmed at 60° C. sealed with nitrogen gas. The two components were heated to 90° C. during mixing by a screw stirrer and reaction was continued at 90° C. for 6 hours. Components (A) and (B) were mixed in a ratio of 100:0, 95:5, 90:10, and 70:30 so that the resulting mixture finishing agent had a viscosity of 73, 125, 250, and 560 mPa·s at 30° C., respectively, and a surface tension of 36.4, 34.8, 35.3, and 36.9 dyn/cm, respectively.

A solution of polyurethane was prepared in the same way as in Example 1. The solution was extruded from a spinneret into hot air for dry spinning. The yarn with false twist was brought into contact with a roller carrying one of the four finishing agents which were prepared as mentioned above. The rotary speed of the roller was adjusted so that the loading of the finishing agent was as shown in Table 4, 10.0% for No. 15 to No. 18; 15% for No. 19; 3.0% for No. 20; and 1.5% for No. 21. The treated yarn was wound up on a paper tube at a rate of 500 m/min, with an elongation of 5%. Thus there was obtained two packages each weighing 2.0 kg of 560-denier polyurethane elastic yarn consisting of 56 filaments. Samples of package varying in the ratio of components (A) and (B) of finishing agent and the loading were designated as Sample No. 15 to No. 21, respectively. Incidentally, each package had a thickness-to-width ratio of 1.2.

The thus obtained samples of polyurethane elastic yarn were examined for bonding properties and loading of finishing agent, and the samples of package were examined for appearance of package in shape and unwinding properties. The results are shown in Table 4.

TABLE 4

| | Sample No. | | | | | | |
|---|---|---|---|---|---|---|---|
| | No. 15 | No. 16 | No. 17 | No. 18 | No. 19 | No. 20 | No. 21 |
| Finishing agent (A):(B) | 100:0 | 95:5 | 90:10 | 70:30 | 90:10 | 90:10 | 90:10 |
| Viscosity of finishing agent (mPa · s) | 73 | 125 | 250 | 560 | 250 | 250 | 250 |
| Surface tension of finishing agent (dyn/cm) | 36.4 | 34.8 | 35.3 | 36.9 | 35.3 | 35.3 | 35.3 |
| Loading of finishing agent (%) | 9.7 | 9.5 | 9.8 | 9.9 | 14.5 | 3.0 | 1.7 |
| Unwinding properties (%) | | | | | | | |
| Immediately after preparation | 50 | 52 | 58 | 79 | 59 | 53 | 40 |
| After one month | 60 | 62 | 67 | 86 | 65 | 67 | 74 |
| Appearance of package in shape | 4 | 4 | 4 | 4 | 3 | 4 | 4 |
| Bonding properties (g) | 35.5 | 40.5 | 42.6 | 42.2 | 42.2 | 40.2 | 36.5 |

It is apparent from Table 4 that No. 18 is poor in unwinding properties because the finishing agent is too high in viscosity, No. 19 is good in unwinding properties but is poor in appearance of package in shape because of the excess loading of the finishing agent, and No. 21 is good in bonding properties but poor in unwinding properties because of the low loading of the finishing agent.

By contrast, Sample No. 15, which was given the finishing agent composed of component (A) only, is good in bonding properties although not better than Comparative Sample No. 2 in Example 3 and good in bonding properties and unwinding properties without mutual sticking of yarn.

Moreover, Sample No. 16, No. 17, and No. 20, which were given the finishing agent composed of component (A) and 5–30 wt % of component (B), are better than Comparative Sample No. 2 in Example 3, which was not given the finishing agent, in bonding properties, appearance of package in shape, and unwinding properties. In addition, they remain unchanged in unwinding properties even one month after production. This suggests that mutual sticking of yarn did not occur during storage.

What is claimed is:

1. A package of polyurethane elastic yarn for heat bonding which is obtained from polyurethane elastic yarn by treating it with 3.0–10.0 wt % of a finishing agent and then winding it, said finishing agent being a polypropylene diol and/or triol having a weight-average molecular weight of 200–1500, which is obtained by the polymerization of propylene oxide alone or by the polymerization of propylene oxide and ethylene oxide.

2. A package of polyurethane elastic yarn for heat bonding as defined in claim 1, wherein the finishing agent is one which has an apparent viscosity of 50–250 mPa·s at 30° C. and a surface tension of 30–45 dyn/cm.

3. A package of polyurethane elastic yarn for heat bonding as defined in claim 2, which weighs more than 1 kg and measures such that the ratio of winding thickness to winding width is greater than 0.5.

4. A package of polyurethane elastic yarn for heat bonding as defined in claim 1, which weighs more than 1 kg and measures such that the ratio of winding thickness to winding width is greater than 0.5.

5. A package of polyurethane elastic yarn for heat bonding which is obtained from polyurethane elastic yarn by treating it with 3.0–10.0 wt % of a finishing agent and then winding it, said finishing agent being composed of component (A), which is a polypropylene diol and/or triol having a weight-average molecular weight of 200–1500 obtained by the polymerization of propylene oxide alone or by the polymerization of propylene oxide and ethylene oxide and component (B) which is a reaction product of the component (A) and an organic diisocyanate compound.

6. A package of polyurethane elastic yarn for heat bonding as defined in claim. 5, wherein the finishing agent contains component (B) in an amount less than 30 wt % thereof.

7. A package of polyurethane elastic yarn for heat bonding as defined in claim 6, wherein the finishing agent is one which has an apparent viscosity of 50–250 mpa·s at 30° and a surface tension of 30–45 dyn/cm.

8. A package of polyurethane elastic yarn for heat bonding as defined in claim 6, which weighs more than 1 kg and measures such that the ratio of winding thickness to winding width is greater than 0.5.

9. A package of polyurethane elastic yarn for heat bonding as defined in claim 5, wherein the finishing agent is one which has an apparent viscosity of 50–250 mPa·s at 30° and a surface tension of 30–45 dyn/cm.

10. A package of polyurethane elastic yarn for heat bonding as defined in claim 5, which weighs more than 1 kg and measures such that the ratio of winding thickness to winding width is greater than 0.5.

* * * * *